US008469729B2

(12) United States Patent
Ding

(10) Patent No.: US 8,469,729 B2
(45) Date of Patent: Jun. 25, 2013

(54) ROTARY WIRELESS NETWORK CARD WITH DOUBLE ROTATING SHAFTS

(75) Inventor: Lei Ding, Shenzhen (CN)

(73) Assignee: ZTE Corporation, Shenzhen (CN)

( * ) Notice: Subject to any disclaimer, the term of this patent is extended or adjusted under 35 U.S.C. 154(b) by 0 days.

(21) Appl. No.: 13/257,861

(22) PCT Filed: Dec. 14, 2009

(86) PCT No.: PCT/CN2009/075560

§ 371 (c)(1),
(2), (4) Date: Jan. 16, 2012

(87) PCT Pub. No.: WO2011/006333

PCT Pub. Date: Jan. 20, 2011

(65) Prior Publication Data

US 2012/0108087 A1 May 3, 2012

(30) Foreign Application Priority Data

Jul. 16, 2009 (CN) ..... 2009 1 0158576

(51) Int. Cl.
*H01R 13/44* (2006.01)

(52) U.S. Cl.
USPC ..... 439/131

(58) Field of Classification Search
USPC ..... 439/131
See application file for complete search history.

(56) References Cited

U.S. PATENT DOCUMENTS 7,828,599 B2 * 11/2010 Zhao et al. ..... 439/607.34
8,075,318 B2 * 12/2011 Zhao et al. ..... 439/13

(Continued)

FOREIGN PATENT DOCUMENTS

CN 201114115 Y 9/2008
CN 201213189 Y 3/2009

(Continued)

OTHER PUBLICATIONS

Supplementary European Search Report in European application No. 09847258.2, mailed on Jul. 5, 2012.

(Continued)

*Primary Examiner* — Briggitte R Hammond
(74) *Attorney, Agent, or Firm* — Oppendahl Patent Law Firm LLC

(57) ABSTRACT

The present disclosure provides a rotary wireless network card with double rotating shafts, which comprises a wireless network card body, an ultra-thin USB interface and a first rotating shaft, wherein at the top of the wireless network card body a opening is provided to accommodate the ultra-thin USB interface as withdrawn; the ultra-thin USB interface extends out of or returns back to the opening by rotating around the first rotating shaft; inside the wireless network card body a rotating shaft support is provided; a second rotating shaft in the opening is rotatably connected to the rotating shaft support; the second rotating shaft is accommodated outside the ultra-thin USB interface and connected to the ultra-thin USB interface; and when the second rotating shaft rotates in the opening, the ultra-thin USB interface and the first rotating shaft rotate in the opening along with the second rotating shaft. By designing a rotary head, the present disclosure frees a USB from the external connection with a cap or other objects that are easily lost or broken, and as the rotary shaft of the ultra-thin USB interface is smaller than common rotary shafts, the whole wireless network card is much shorter and narrower, causing no interference on the use of a neighboring interface.

15 Claims, 2 Drawing Sheets

U.S. PATENT DOCUMENTS

| | | | | |
|---|---|---|---|---|
| 8,125,774 | B2 * | 2/2012 | Kelley et al. | 361/679.31 |
| 8,206,163 | B2 * | 6/2012 | Zhao et al. | 439/131 |
| 2007/0205334 | A1 | 9/2007 | Kim | |
| 2011/0034048 | A1 * | 2/2011 | Zhao et al. | 439/131 |
| 2011/0217858 | A1 * | 9/2011 | Zhao et al. | 439/131 |

FOREIGN PATENT DOCUMENTS

| | | | |
|---|---|---|---|
| DE | 202007006899 | U1 | 10/2007 |
| EP | 1515439 | A2 | 3/2005 |
| EP | 1809033 | A1 | 7/2007 |

OTHER PUBLICATIONS

International Search Report in international application No. PCT/CN2009/075560, mailed on Apr. 22, 2010.

English Translation of the Written Opinion of the International Search Authority in international application No. PCT/CN2009/075560, mailed on Apr. 22, 2010.

* cited by examiner

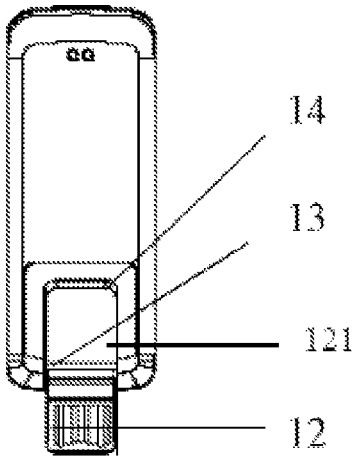
Fig. 1a
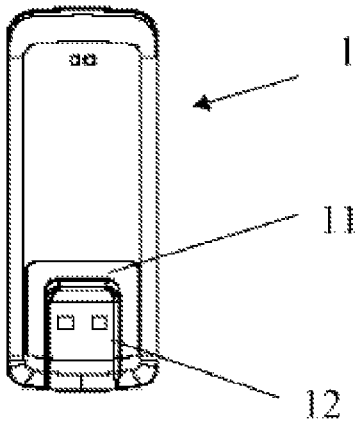
Fig. 1b
Fig.1
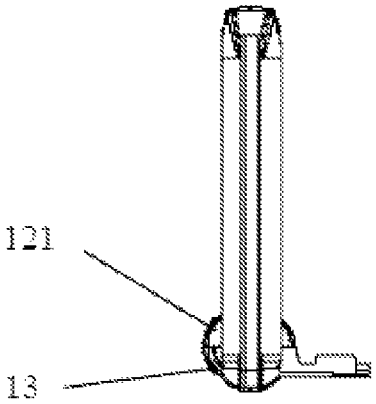
Fig. 2a
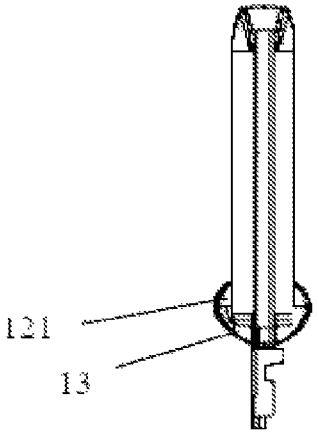
Fig. 2b
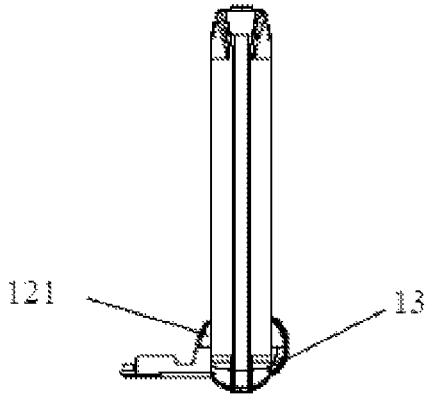
Fig. 2c
Fig.2

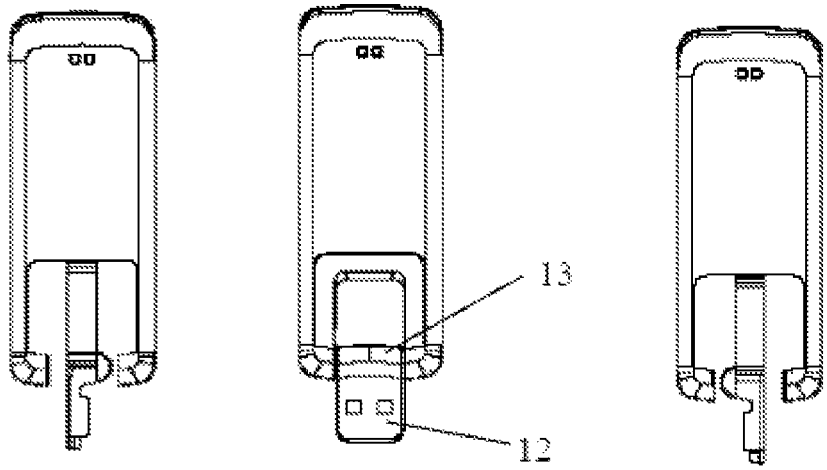
Fig. 3a Fig. 3b Fig. 3c
Fig.3
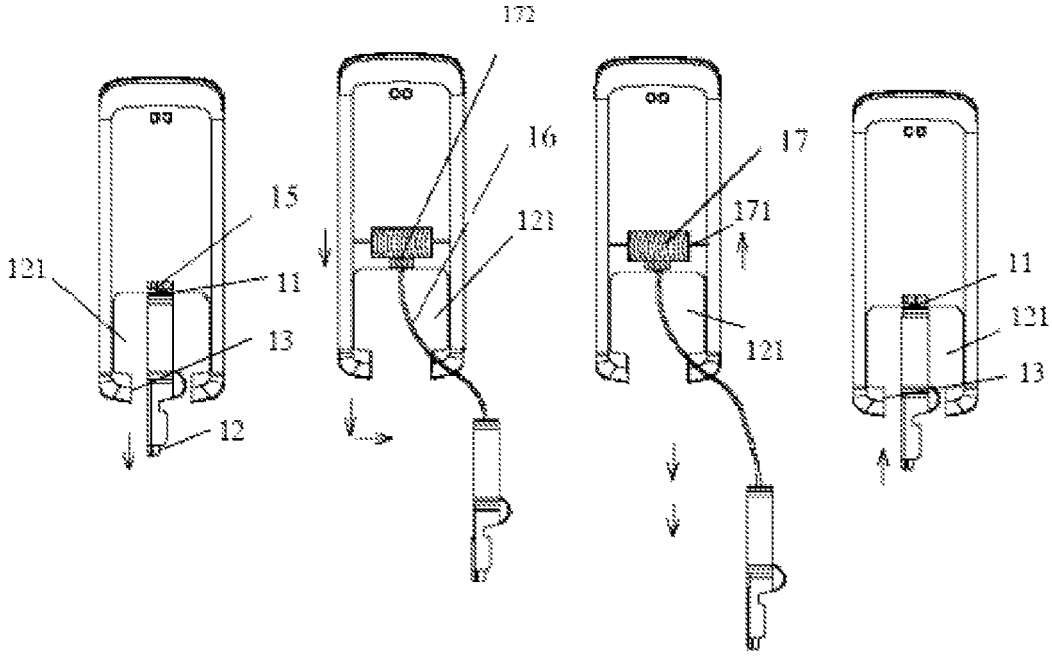
Fig. 4a Fig. 4b Fig. 4c Fig. 4d
Fig.4

ROTARY WIRELESS NETWORK CARD WITH DOUBLE ROTATING SHAFTS

TECHNICAL FIELD

The present disclosure relates to the technical field of wireless terminal products, particularly to a rotary wireless network card with double rotating shafts.

BACKGROUND

With the development of science and technology, wireless network card, as an important part of wireless network, facilitates the instant access of a user to a wireless network and supports mobile users, temporary working stations, shared network equipments and wireless multimedia. A multifunctional wireless network card can help a user perform fund management and investment and enjoy the fun of internet surfing, music and electronic books. Thus it can be said that the use of wireless network card products has become a main trend. However, due to the interface position of the wireless network card and the shape and size of the notebook computer, there may well be a mutual interference between them when the wireless network card is connected to the notebook computer, making it inconvenient to use the notebook computer.

A Universal Serial Bus (USB) network card is currently provided, which is designed to have a cap to avoid damage caused by the exposure of the USB interface. But the cap is easy to be lost and forgotten, and inclines to be broken after a long-period use even with a connection line.

There also is a wireless network card with a large volume rotating shaft. However, such a wireless network card, when connected to a notebook computer, often blocks neighboring interfaces and affects the use of them due to the increased in size, volume and width caused by the large volume rotating shaft. In this case, a USB extension cable, as an accessory, will need to be added to the wireless network card, which whereas incur an increased cost and a trouble of carrying accessories. A wireless network card is required in appearance to be fashionable and beautiful indeed, but more than that, the shape of the wireless network card should not cause any inconvenience to the user of a notebook computer. A notebook computer has many wireless or wired interfaces, and there are also many interfaces close to a USB interface, for example, 1394, audio interface, network interface, telephone interface, power supply interface and other USB interfaces in the same row with the USB interface or adjacent to the USB interface and the like.

Chinese patent CN200720156339.6 discloses a wireless network card, which comprises a main body part, a USB connector part that is arranged at one end of the main body part and rotatably connected to the main body part via a first shaft, and a protecting cover that is rotatably connected to the main body part via a second shaft. The wireless network card, as disclosed in the patent, is free of the breaking problem caused by the over-length of the wireless network card after being inserted into a port, and can be repositioned as required by a user. Additionally, when not in use, the wireless network card can protect with its own protecting cover the USB interface to guarantee the integrity in appearance.

However, in the above patent, the USB rotating head is over-thick, the rotating shaft is over-big and over-wide, thus the use of other interfaces in a notebook computer is affected. Besides, an over-big rotating shaft also affects the heat radiation of the USB network card. Furthermore, all the current wireless network cards available in market are interfered with the interfaces mentioned above, or the wireless network cards are over-big, over-wide and over-long, affecting the normal use of a notebook computer.

SUMMARY

The technical problem to be solved by the present disclosure is to provide a rotary wireless network card with double rotating shafts, the rotary design of which can make the wireless network card be repositioned as required to avoid various adjacent interfaces so as to eliminate the influence on the use of them.

In order to solve the above problem, the present disclosure provides a rotary wireless network card with double rotating shafts, comprising a wireless network card body, an ultra-thin USB interface and a first rotating shaft, wherein the wireless network card body is configured so that a opening is arranged at the top of the wireless network card body to accommodate the ultra-thin USB interface as withdrawn, a rotating shaft support is arranged inside the wireless network card body, and a second rotating shaft is arranged in the opening to rotatably connect to the rotating shaft support, wherein the second rotating shaft is accommodated outside the ultra-thin USB interface and connected to the ultra-thin USB interface; the ultra-thin USB interface is configured to extend out of or return back to the opening by rotating around the first rotating shaft; the first rotating shaft is configured to make the ultra-thin USB interface extend out of or return back to the opening by rotating the ultra-thin USB interface rotate around the first rotating shaft; and when the second rotating shaft rotates in the opening, the ultra-thin USB interface and the first rotating shaft rotate in the opening along with the second rotating shaft.

Further, the wireless network card body may be further configured so that a slide rail is arranged inside the wireless network card body to match with the second rotating shaft; and the second rotating shaft, when sliding along the slide rail, drives the ultra-thin USB interface to slide into the opening in the wireless network card body.

Further, the wireless network card body may be further configured so that an extending parts is arranged at the opening to prevent the second rotating shaft from sliding out of the wireless network card body along the slide rail.

Further, a cable coiler may be arranged on the rotating shaft support, a built-in extension cable is arranged between the second rotating shaft and the cable coiler; and the built-in extension cable may be configured so that when the ultra-thin USB interface is rotated to a certain angle around the second rotating shaft, the second rotating shaft and the ultra-thin USB interface are taken down from the rotating shaft support by pulling the built-in extension cable.

Further, the certain angle may be an arbitrary angle in the range of 90 degree to 270 degree.

Further, the built-in extension cable may be further configured so that the ultra-thin USB interface releases from or withdraw into the wireless network card body by pulling or withdrawing the built-in extension cable through a rotation of a rotating shaft of the cable coiler.

Further, a position-blocking mechanism may be arranged on the cable coiler to position the built-in extension cable as pulled out.

The rotating head design adopted by the present disclosure frees a USB from the external connection with a cap or other objects that are easily lost or broken. The rotary USB interface is free of the external connection with a cap and can be automatically opened and closed via the rotating shafts to be protected, eliminating the bad contact between a wireless network card subjected to an external force and a notebook computer and the breaking of the wireless network card. Additionally, as the rotating shafts of the ultra-thin USB interface are smaller than common rotating shafts, the whole wireless network card is much shorter and narrower, having no interference on the use of neighboring interfaces.

Furthermore, the design of the double rotating shafts of the USB interface enables the user to freely adjust the position and the state of the ultra-thin network card that is inserted into a notebook computer to keep the ultra-thin network card away from other interfaces, so no interference is caused on the use of the notebook computer, the display screen of the notebook is not blocked, and the keyboard operation is not affected. Additionally, after the USB rotating head is closed, neither separation sign nor accessory is represented in the appearance of the product, so the integrity of the product is excellent. The built-in connecting extension cable enables the USB plug to be used independent of the network card body as a USB extension cable.

Compared with the prior art, the device of the present disclosure reduces the volume of the wireless network card body, making the wireless network card body more fashionable and beautiful in appearance. Furthermore, the wireless network card is convenient to carry and can be use as an ornament. The built-in extension cable, which can serve as a USB extension cable, is convenient to carry and switch. The double rotating shafts design keeps the wireless network card away from other interfaces of a notebook computer, having no interference on the interfaces. The built-in connecting extension cable can serve as a USB extension cable due to its capacity of enabling the use of the USB plug independent of the network card body. The small-sized wireless network card having flexible double rotating shafts and an ultra-thin interface is convenient to carry and suspend and is beautiful when used as an ornament.

BRIEF DESCRIPTION OF THE DRAWINGS

FIG. 1*a* is a structural diagram of a rotary wireless network card with double rotating shafts in an open state according to an embodiment of the present disclosure;

FIG. 1*b* is a structural diagram of a rotary wireless network card with double rotating shafts in a close state according to an embodiment of the present disclosure;

FIG. 2*a* is a state diagram of the ultra-thin USB interface, when rotated 90 degree around a first rotating shaft, according to the embodiment shown in FIG. 1*b;*

FIG. 2*b* is a state diagram of the ultra-thin USB interface, when rotated 180 degree around the first rotating shaft, according to the embodiment shown in FIG. 1*b;*

FIG. 2*c* is a state diagram of the ultra-thin USB interface, when rotated 270 degree around the first rotating shaft, according to the embodiment shown in FIG. 1*b;*

FIG. 3*a* is a state diagram of the ultra-thin USB interface, when rotated 90 degree around a second rotating shaft, according to the embodiment shown in FIG. 1*a;*

FIG. 3*b* is a state diagram of the ultra-thin USB interface, when rotated 180 degree around the second rotating shaft, according to the embodiment shown in FIG. 1*a;*

FIG. 3*c* is a state diagram of the ultra-thin USB interface, when rotated 270 degree around the second rotating shaft, according to the embodiment shown in FIG. 1*a;*

FIG. 4*a* is a state diagram of the ultra-thin USB interface, when rotated to certain angle, according to an embodiment of the present disclosure;

FIG. 4*b* is a state diagram of a built-in extension cable, when being pulled, according to an embodiment of the present disclosure;

FIG. 4*c* is a state diagram of the built-in extension cable, when being further pulled, according to an embodiment of the present disclosure; and FIG. 4*d* is a state diagram of the built-in extension cable, when being withdrawn, according to an embodiment of the present disclosure.

DETAILED DESCRIPTION

The present disclosure will be described in detail by reference to the drawings in combination with concrete embodiments.

FIG. 1 shows a rotary wireless network card with double rotating shafts according to an embodiment of the present disclosure. The rotary wireless network card shown in FIG. 1 comprises a wireless network card body 1, an ultra-thin USB interface 12 and a first rotating shaft 13, wherein the ultra-thin USB interface 12 is rotatably connected to the wireless network card body 1 through the first rotating shaft 13, a opening 121 is provided at the top of the wireless network card body 1 to accommodate the ultra-thin USB interface 12 as withdrawn, and the ultra-thin USB interface 12 can extend out of or return back to the opening 121 by rotating around the first rotating shaft 13. The wireless network card body 1 comprises a USB head, a main body, a signal lamp, a test hole, an ornament piece and other existing components.

As shown in FIG. 1, the wireless network card body 1 disclosed in the present disclosure is U-shaped. The U-shaped body 1 differs from the prior art in having an inward (namely, in a folding direction) extending part at the opening 121 at the top of the body and in having a second rotating shaft 11 which is arranged in the opening 121 of the wireless network card body 1 and accommodated outside the ultra-thin USB interface 12 and connected thereto. A slide rail 14 to match with the second rotating shaft 11 is arranged inside the U-shaped wireless network card body 1.

Referring to FIG. 1*a*, when being used, the ultra-thin USB interface 12 can be rotated around the first rotating shaft 13 to open and to an easy-to-use angle. Referring to FIG. 1*b*, after being used, the ultra-thin USB interface 12 can be inserted, along with the second rotating shaft 11, into the U-shaped wireless network card body 1, the ultra-thin USB interface 12 will then be in a close state; this helps avoid a design of a USB cap. The extending part at the opening 121 is used to prevent the ultra-thin USB interface 12, when not being used, from sliding out of the U-shaped wireless network card body 1 along the slide rail 14. Using the slide rail 14, the ultra-thin USB interface 12 will not loose out by an unintended touch of a user. Rather, the wireless network card body 1, when being touched, can slide with the second rotating shaft 11 along the slide rail 14 to avoid a force-bearing point.

Referring to FIG. 2, the first rotating shaft 13 can control the ultra-thin USB interface 12 to rotate around the first rotating shaft 13 at the top of the wireless network card body 90 degree (as shown in FIG. 2*a*), 180 degree (as shown in FIG. 2*b*), 270 degree (as shown in FIG. 2*c*) or any other degree, to easily insert into a USB port of a notebook computer for use.

As shown in FIG. 3, the first rotating shaft 13 and the ultra-thin USB interface 12 can be connected to the second rotating shaft 11 and rotate with it together in the opening 121 90 degree (as shown in FIG. 3*a*), 180 degree (as shown in FIG. 3*b*), 270 degree (as shown in FIG. 3*c*), or any other degree. In combination with the rotation around the first rotating shaft 13 as shown in FIG. 2, the ultra-thin USB interface 12 can be rotated any degree with respect to the wireless network card body 1 to effectively avoid various interfaces of a notebook computer and to allow a user to use a number of functions of the notebook computer simultaneously.

FIG. 4 shows a wireless network card with a built-in extension cable according to an embodiment of the present disclosure. As shown in FIG. 4, a rotating shaft support 15 is arranged on the wireless network card body 1 to connect the second rotating shaft 11 to the wireless network card body 1. A built-in extension cable 16 is arranged between the second rotating shaft 11 and the rotating shaft support 15 to enable the use of the ultra-thin USB interface 12 independent of the wireless network card body 1 by way of the built-in extension cable 16.

Referring to FIG. 4, the built-in extension cable is wound on a cable coiler 17 and can be pulled and withdrawn by rotating around a rotating shaft 171 of the cable coiler 17. The cable coiler 17 is fixed in the wireless network card body 1 through the rotating shaft support 15. When the ultra-thin USB interface 12 is rotated around the second rotating shaft 11 to an angle in the range of 90 degree to 270 degree (only in this range can the ultra-thin USB interface 12 be released from the U-shaped wireless network card body 1), the second rotating shaft 11 and the ultra-thin USB interface 12 can be taken down from the rotating shaft support 15, and the rotating shaft of the cable coder then can be rotated under a pull force to enable the built-in extension cable 16 to be pulled out and positioned for use. In the embodiment of the present disclosure, the cable coiler 17 may be provided with a blocking mechanism 172 which allows the built-in extension cable 16 to be pulled out when a pull force greater than the drag force generated by the blocking mechanism 172 is applied and then positions the built-in extension cable 16 as pulled out. If want to withdraw the built-in extension cable 16 after being used, pull the built-in extension cable 16 outwards once again and then loose it to release the blocked point of positioning the cable, so that the rotating shaft of the cable caller 17 can rotate reversely to withdraw the built-in extension cable 16 back to the cable cater 17. Repeat the operation above if a next use is needed.

With the above arrangement of the built-in extension cable, after pulling the built-in extension cable out, the user can place the wireless network card body 1 at a best position for signals, and insert the ultra-thin USB interface 12 into a USB port of a notebook computer for use. Since the ultra-thin USB interface 12 is used by connecting itself to the wireless network card body 1 via a connection cable, its connection to a PC computer does not affect the normal plugging/unplugging operation and use of other adjacent interfaces.

To sum up, the rotary design of the rotatable ultra-thin USB interface of the present disclosure avoids an easy-to-lost cap and effectively protects the USB against damage. The rotary design of the double rotating shafts enables a second rotation of the USB rotating shaft with respect to the wireless network card body, effectively avoiding an interference with other interfaces due to the width of a USB network card. By means of the built-in extension cable, the rotating shaft of the USB interface can be taken down from the second rotating shaft support for use when the second rotating shaft is rotated to an arbitrary angle in the range of 90 degree to 270 degree. The arrangement of the built-in extension cable lowers cost and avoids the addition of a USB extension cable accessory and the loss of a USB extension cable accessory as well; the built-in extension cable is convenient to carry and use and can be pulled out and lengthened by an external force and coil line automatically; the user can place the wireless network card freely to find a best point for signals to use the wireless network card; and the built-in extension cable enables the use of the wireless network card away from people, thereby reducing the radiation to people.

INDUSTRIAL APPLICABILITY

The rotary design of the rotatable ultra-thin USB interface of the present disclosure avoids an easy-to-lost cap and effectively protects the USB against damage. The rotary design of the double rotating shafts enables a second rotation of the USB rotating shaft with respect to the wireless network card body, effectively avoiding an interference with other interfaces due to the width of a USB network card. By means of the built-in extension cable, the rotating shaft of the USB interface can be taken down from the second rotating shaft support for use when the second rotating shaft is rotated to an arbitrary angle in the range of 90 degree to 270 degree. The arrangement of the built-in extension cable lowers cost and avoids the addition of a USB extension cable accessory and the loss of a USB extension cable accessory as well; the built-in extension cable is convenient to carry and use and can be pulled out and lengthened by an external force and coil line automatically; the user can place the wireless network card freely to find a best point for signals to use the wireless network card; and the built-in extension cable enables the use of the wireless network card away from people, thereby reducing the radiation to people.

What is claimed is:

1. A rotary network card with double rotating shafts, comprising a network card body, an ultra-thin USB interface and a first rotating shaft, wherein the network card body is configured so that a opening is arranged at a top of the network card body to accommodate the ultra-thin USB interface as withdrawn, a rotating shaft support is arranged inside the network card body, and a second rotating shaft is arranged in the opening to rotatably connect to the rotating shaft support, wherein the second rotating shaft is accommodated outside the ultra-thin USB interface and connected to the ultra-thin USB interface;

the ultra-thin USB interface is configured to extend out of or return back to the opening by rotating around the first rotating shaft;

the first rotating shaft is configured to make the ultra-thin USB interface extend out of or return back to the opening by rotating the ultra-thin USB interface rotate around the first rotating shaft; and when the second rotating shaft rotates in the opening, the ultra-thin USB interface and the first rotating shaft rotate in the opening along with the second rotating shaft.

2. The network card according to claim 1, wherein the network card body is further configured so that a slide rail is arranged inside the network card body to match with the second rotating shaft; and the second rotating shaft, when sliding along the slide rail, drives the ultra-thin USB interface to slide into the opening in the network card body.

3. The network card according to claim 2, wherein the network card body is further configured so that an extending parts is arranged at the opening to prevent the second rotating shaft from sliding out of the network card body along the slide rail.

4. The network card according to claim 1, wherein a cable coiler is arranged on the rotating shaft support, a built-in extension cable is arranged between the second rotating shaft and the cable coiler; and the built-in extension cable is configured so that when the ultra-thin USB interface is rotated to a certain angle around the second rotating shaft, the second rotating shaft and the ultra-thin USB interface are taken down from the rotating shaft support by pulling the built-in extension cable.

5. The network card according to claim 4, wherein the certain angle is an arbitrary angle in the range of 90 degree to 270 degree.

6. The network card according to claim 4, wherein the built-in extension cable is further configured so that the ultra-thin USB interface releases from or withdraw into the network card body by pulling or withdrawing the built-in extension cable through a rotation of a rotating shaft of the cable coiler.

7. The network card according to claim 4, wherein a position-blocking mechanism is arranged on the cable coiler to position the built-in extension cable as pulled out.

8. The network card according to claim 2, wherein a cable coiler is arranged on the rotating shaft support, a built-in extension cable is arranged between the second rotating shaft and the cable coiler; and the built-in extension cable is configured so that when the ultra-thin USB interface is rotated to a certain angle around the second rotating shaft, the second rotating shaft and the ultra-thin USB interface are taken down from the rotating shaft support by pulling the built-in extension cable.

9. The network card according to claim 8, wherein the certain angle is an arbitrary angle in the range of 90 degree to 270 degree.

10. The network card according to claim 8, wherein the built-in extension cable is further configured so that the ultra-thin USB interface releases from or withdraw into the network card body by pulling or withdrawing the built-in extension cable through a rotation of a rotating shaft of the cable coiler.

11. The network card according to claim 8, wherein a position-blocking mechanism is arranged on the cable coiler to position the built-in extension cable as pulled out.

12. The network card according to claim 3, wherein a cable coiler is arranged on the rotating shaft support, a built-in extension cable is arranged between the second rotating shaft and the cable coiler; and the built-in extension cable is configured so that when the ultra-thin USB interface is rotated to a certain angle around the second rotating shaft, the second rotating shaft and the ultra-thin USB interface are taken down from the rotating shaft support by pulling the built-in extension cable.

13. The network card according to claim 12, wherein the certain angle is an arbitrary angle in the range of 90 degree to 270 degree.

14. The network card according to claim 12, wherein the built-in extension cable is further configured so that the ultra-thin USB interface releases from or withdraw into the network card body by pulling or withdrawing the built-in extension cable through a rotation of a rotating shaft of the cable coiler.

15. The network card according to claim 12, wherein a position-blocking mechanism is arranged on the cable coiler to position the built-in extension cable as pulled out.

* * * * *

UNITED STATES PATENT AND TRADEMARK OFFICE

CERTIFICATE OF CORRECTION

PATENT NO. : 8,469,729 B2
APPLICATION NO. : 13/257861
DATED : June 25, 2013
INVENTOR(S) : Lei Ding It is certified that error appears in the above-identified patent and that said Letters Patent is hereby corrected as shown below:

Title Page, please delete:
"(74) Attorney, Agent, or Firm - Oppendahl Patent Law Firm LLC"

And insert the following correction:
-- (74) Attorney, Agent, or Firm - Oppedahl Patent Law Firm LLC --

Signed and Sealed this
Seventeenth Day of September, 2013

Teresa Stanek Rea
*Deputy Director of the United States Patent and Trademark Office*